US005851317A

United States Patent [19]

Biner et al.

[11] Patent Number: 5,851,317

[45] Date of Patent: Dec. 22, 1998

[54] COMPOSITE MATERIAL REINFORCED WITH ATOMIZED QUASICRYSTALLINE PARTICLES AND METHOD OF MAKING SAME

[75] Inventors: Suleyman B. Biner; Daniel J. Sordelet; Barbara K. Lograsso; Iver E. Anderson, all of Ames, Iowa

[73] Assignee: Iowa State University Research Foundation, Inc., Ames, Iowa

[21] Appl. No.: 792,285

[22] Filed: Jan. 31, 1997

Related U.S. Application Data

[63] Continuation of Ser. No. 502,843, Jul. 14, 1995, abandoned, which is a continuation-in-part of Ser. No. 127,264, Sep. 27, 1993, Pat. No. 5,433,978.

[51] Int. Cl.[6] ..... C22C 21/00

[52] U.S. Cl. ..... 148/403; 148/438; 420/538; 428/614; 428/650

[58] Field of Search ..... 148/403, 438; 420/538; 428/614, 650

[56] References Cited

U.S. PATENT DOCUMENTS 5,204,191 4/1993 DuBois et al. ..... 420/538
5,419,789 5/1995 Kita ..... 148/403
5,433,978 7/1995 Shibld et al. ..... 75/338
5,458,700 10/1995 Masumoto et al. ..... 148/403

OTHER PUBLICATIONS

"Synthesis of Stable Quasicrystalline particle–dispersed Al Base Composite Alloys" J. Mater. Res, vol. 8, No. 1, Jan. 1993, Tsai et al.

*Primary Examiner*—George Wyszomierski
*Attorney, Agent, or Firm*—Edward J. Timmer

[57] ABSTRACT

A composite material comprises an aluminum or aluminum alloy matrix having generally spherical, atomized quasicrystalline aluminum-transition metal alloy reinforcement particles disposed in the matrix to improve mechanical properties. A composite article can be made by consolidating generally spherical, atomized quaiscrystalline aluminum-transition metal alloy particles and aluminum or aluminum alloy particles to form a body that is cold and/or hot reduced to form composite products, such as composite plate or sheet, with interfacial bonding between the quasicrystalline particles and the aluminum or aluminum alloy matrix without damage (e.g. cracking or shape change) of the reinforcement particles. The cold and/or hot worked compositehibits substantially improved yield strength, tensile strength, Young's modulus (stiffness).

12 Claims, 2 Drawing Sheets

COMPOSITE MATERIAL REINFORCED WITH ATOMIZED QUASICRYSTALLINE PARTICLES AND METHOD OF MAKING SAME

This application is a continuation of U.S. Ser. No. 08/502,843, filed Jul. 14, 1995, abandoned, which is a CIP of U.S. Ser. No. 08/127,264, filed on Sep. 27, 1993, now U.S. Pat. No. 5,433,995.

CONTRACTURAL ORIGIN OF THE INVENTION

The United States Government has rights in this invention pursuant to Contract No. W-7405-ENG-82 between the U.S. Department of Energy and Iowa State University, Ames, Iowa, which contract grants to Iowa State University Research Foundation, Inc. the right to apply for this patent.

FIELD OF THE INVENTION

The present invention relates to composite materials reinforced with quasicrystalline alloy particles and methods for their manufacture.

BACKGROUND OF THE INVENTION

Certain aluminum-transition metal aloys, such as Al—Cu—Fe, exhibit noncrystallographic rotational symmetries and aperiodic translational order in one, two, or three dimensions. These alloys are commonly referred to as quasicrystals, and their structure is neither amorphous nor crystalline. The unique structure and chemistry team to provide high mechanical hardness with good chemical stability. The structure and properties of quasicrystals are described in the Stephens and Goldman article "The Structure of Quasicrystals", *Scientific American*, April, 1991, the teachings of which are incorporated herein by reference with respect to the quasicrystalline structures involved.

Copending patent application Ser. No. 08/127,264 of common assignee herewith discloses making quasicrystalline aluminum-transition metal alloy particulates or powder by the gas atomization of a superheated, chemically homogenous melt of the alloy and consolidation by hot isostatic pressing or plasma spraying to form a quasicrystalline article or coating.

Particulate reinforced aluminum and aluminum alloy composites are under study for applications in the aerospace, automotive, electronic packing, and other high performance service applications where high performance material properties are needed. For example, these composites materials exhibit desirable properties including low density, high stiffness, high strength and reduced coefficient of thermal expansion along with the amenability to relatively low cost, high volume production techniques. However, these composites exhibit low damage tolerance (e.g. as measured by fracture toughness, ductility, and fatigue crack growth resistance) which can be a concern and disadvantage in a wide range of service applications.

The low damage tolerance of these composites originates from the angular nature of the reinforcements (e.g. SiC, TiC, $B_4C$, $Al_2O_3$ and the like) used in their production. Such angular reinforcements create stress concentrations and enhance the localized matrix strains that can lead to premature failure of the composites. Also, the initial spatial distribution of the reinforcing particles in the matrix influences the damage tolerance of these composites. Regions of particle clustering have been found to exert a negative influence on the reistance of the composites to damage initiation and also to provide favorable paths for linkage of damage.

Currently, the recycling of these composites produced by using conventional reinforcements is not a problem due to their very specific applications. However, with increased usage of these composites, recycling difficulties may occur since the reinforcing particles are quite stable at high temperatures provided by conventional smelting processes used for recyling, rendering the particles extremely difficult to separate from the aluminum base matrix material that could be recycled.

An object of the present invention is to provide a composite material comprising a particle reinforced aluminum base matrix that exhibits improved mechanical properties along with improved damage tolerance and ready recycleability.

Another object of the present invention is to provide a method of making such composite materials as cold and/or hot reduced materials.

SUMMARY OF THE INVENTION

The present invention provides a composite material comprising an aluminum or aluminum alloy matrix having generally spherical, atomized quasicrystalline reinforcement particles, such as quasicrystalline aluminum-transition metal alloy reinforcement particles, disposed in the matrix effective to improve mechanical properties.

The present invention also provides for consolidating generally spherical, atomized quasicrystalline reinforcement particles and aluminum or aluminum alloy particles to form a body that then is cold and/or hot reduced (e.g. cold and/or hot rolled) to form composite products, such as composite plate or sheet, with interfacial bonding between the quasicrystalline particles and the aluminum or aluminum alloy matrix without damage (e.g. cracking or deleterious shape change) of the reinforcement particles. The cold and/or hot worked composite material exhibits substantially improved yield strength, tensile strength, Young's modulus (stiffness) as compared to unreinforced aluminum and improved ductility as compared to current composites comprising an aluminum matrix reinforced with angular reinforcement particles.

The present invention will be described in more detail herebelow in the following detailed description taken with the following drawings.

DETAILED DESCRIPTION OF THE INVENTION

The present invention provides a composite material comprising an aluminum or aluminum alloy matrix having generally spherical, atomized quasicrystalline reinforcement particles disposed in the matrix to improve mechanical properties. The generally spherical, atomized quasicrystalline reinforcement particles preferably are aluminum-transition metal alloy particles preferably high pressure gas atomized pursuant to the teachings of copending, allowed application Ser. No. 08/127,264, U.S. Pat. No. 5,433,978, of common assignee wherein a compositionally homogenous Al—Cu—Fe alloy melt is superheated (e.g. superheat of about 100 to about 300 degrees C) in a crucible or other vessel, discharged from the vessel through an atomizing nozzle, and gas atomized by high pressure gas (e.g. about 400 to about 1500 psig at the gas supply regulator) to form generally spherical alloy powder particles in the mean size range of about 20–30 microns diameter. The teachings of U.S. Ser. No. 08/127,264, U.S. Pat. No. 5,433,978, are incorporated herein by reference to this end.

For purposes of illustration, a charge of elemental Al, Cu, and Fe can be placed in a high purity, coarse grain alumina crucible disposed in a melting furnace in amounts to form an alloy melt comprising $Al_{65}Cu_{23}Fe_{12}$ (atomic formula) having a melting temperature of about 1100 degrees C. The Cu charge component can comprise electronic grade (CDA 101) copper. The Fe charge component can comprise electrolytic "Glidden" iron flake. The Al charge component can comprise Al nodules of commercial purity.

Figure 1:
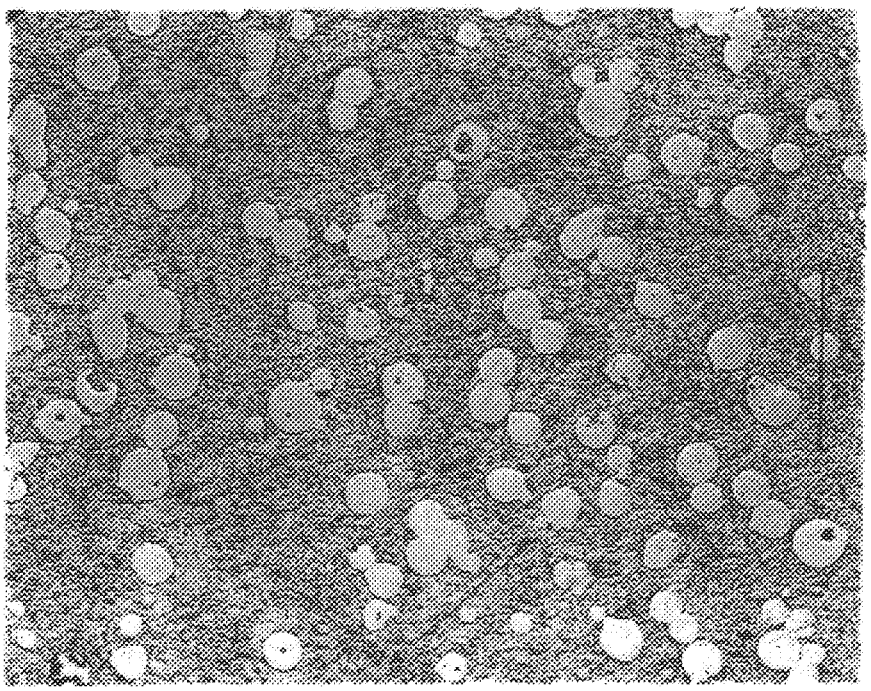
FIG. 1 is a microstructure of a composite material comprising an aluminum matrix and generally spherical, atomized quasicrystalline reinforcement powder particles dispersed in the matrix after hot isostatic pressing.

Prior to melting the charge, the melting chamber is initially evacuated to $30\times10^{-3}$ torr and then backfilled with ultrahigh purity argon to 1.1 atmosphere. The charge components are then induction melted to alloy them prior to atomization to promote good melt homogeneity and to provide a melt temperature of 1330 degrees C, corresponding to a melt superheat of 230 degrees C above the alloy liquidus temperature of 1100 degrees C. The melt temperature is maintained at 1330 degrees C for several minutes to stabilize the melt temperature and to homogenize the melt. Once the melt temperature is stabilized, the melt is released from the crucible by raising a stopper rod for flow through a machinable alumina melt supply tube for atomization by high pressure argon gas jets of an atomizing nozzle as described in U.S. Pat. No. 5,125,574, the teachings of which are incorporated herein by reference. The superheated melt can be atomized by using ultra high purity argon gas at an exemplary pressure of 1100 psig as measured at the gas supply regulator. The atomized melt is discharged from the atomizing nozzle into an atomizing chamber of a vertical drop tube for rapid solidification of the molten atomized alloy droplets. Typically, the atomized droplets pass through a reaction zone of ultra high purity nitrogen established downstream of the atomizing nozzle (e.g. 20 inches downstream) in the drop tube by an annular reactive gas distribution manifold or pipe as shown in FIG. 1 of the aforementioned U.S. Pat. No. 5,125,574. Passage of the atomized droplets through the nitrogen reaction zone results in formation of a protective nitride layer on the atomized Al—Cu—Fe powder particles that renders them non-reactive in a spark test described in the aforementioned U.S. Pat. No. 5,125,574.

The atomized powder particles are collected at the bottom of the drop tube and comprise a predominantly quasicrystalline microstructure as determined by X-ray analysis. The powder particles are generally spherical and in a size range of about 1 to about 100 microns diameter. The majority of the powder particles are less than 38 microns in diameter with the mean particle size being about 20 to about 30 microns in diameter.

The atomized quasicrystalline powder particles can be subsequently heat treated at a suitably high temperature to impart a single phase quasicrystal microstructure to the particles. The heat treatment, if desired, can be performed prior to the hot consolidation of the powder particles with aluminum or aluminum alloy matrix powder particles to a three dimensional body amenable to cold and/or hot reduction.

In one embodiment of the present invention, the quasicrystalline, generally spherical, gas atomized powder particles are mixed with the aluminum or aluminum alloy powder particles in volume percentages effective to provide a reinforcing effect of the aluminum or aluminum alloy matrix. Typically, from about 5 to about 70 volume % of the quasicrystalline atomized powder particles is mixed with the aluminum or aluminum alloy matrix powder particles. The following examples employ 20 volume % of the quasicrystalline powder particles (size range of 1 to 50 microns diameter) mixed with 80 volume % of pure aluminum matrix powder particles (size range of 1 to 100 microns diameter) for purposes of illustration. The aluminum powder particles (Al 1100) were obtained from Nuclear Metals Inc. in the size range indicated. Aluminum alloy powder particles, such as 2024, 6061, and 7075 aluminum alloys, can be used in practicing the invention as well.

The mixture of matrix powder (i.e. Al or Al alloy powder) and quaiscrystalline atomized powder can be initially cold isostatically pressed to form a precursor body for further processing. For example, the mixture of powders can be placed in a urethane rubber tube of cylindrical shape and cold isostatically pressed at 30 ksi for 1 minute to provide a 80–90% dense precursor body. For example, the dimensions of the precursor body can be 1 inch in diameter and 2 inches in length.

The precursor body then is removed from the rubber tube and hot isostactically pressed (HIP'ed) in an aluminum can having a cylindrical shape to form a consolidated composite body having dimensions of 0.75 inch in diameter and less than 2 inches in length. The hot isostatic pressing is conducted at 450 degrees C at 44 ksi argon gas pressure for 4 hours.

Referring to FIG. 1, a typical microstructure of the HIP'ed composite body is shown wherein the matrix comprises pure aluminum and the quasicrystalline reinforcement powder comprises high pressure gas atomized, generally spherical powder particles comprising $Al_{65}Cu_{23}Fe_{12}$ and having a size range of 1 to 50 microns. The general sphericalness and uniform distribution of the atomized quasicrystalline powder particles in the aluminum matrix is evident. The sharp appearance of the reinforcement particle/matrix interfaces in FIG. 1 suggests that the prolonged high temperature (450 degrees C) exposure during hot isostatic pressure consolidation did not promote any significant diffusive intermixing of the phases. It is likely that this suppression of intermixing is aided by the reduced tendency for diffusion in quasicrystals and a diffusion barrier effect of the protective surface layer on the quasicrystalline particles.

The HIP'ed composite body then is cold and/or hot reduced or worked to form a cold and/or hot worked composite material comprising an aluminum or aluminum alloy matrix having generally spherical, atomized quasicrystalline aluminum-transition metal alloy reinforcement particles disposed in the matrix to improve mechanical properties. The cold and/or hot reduction can be conducted by conventional rolling, extrusion, forging, and other like reduction techniques wherein at least one dimension of the HIP'ed body is reduced. The HIP'ed composite body of the present invention can be reduced in this manner due to its high ductility (e.g. 96%) as compared to that (e.g. 10–20%) of prior art type composite materials using the aforementioned angular reinforcement particles in an aluminum matrix. A preferred cold and/or hot reduction is achieved by cold or hot rolling of the HIP'ed composite body of the invention. A substantial reduction in at least one dimension such as the thickness dimension is typical using rolling.

Figure 2:
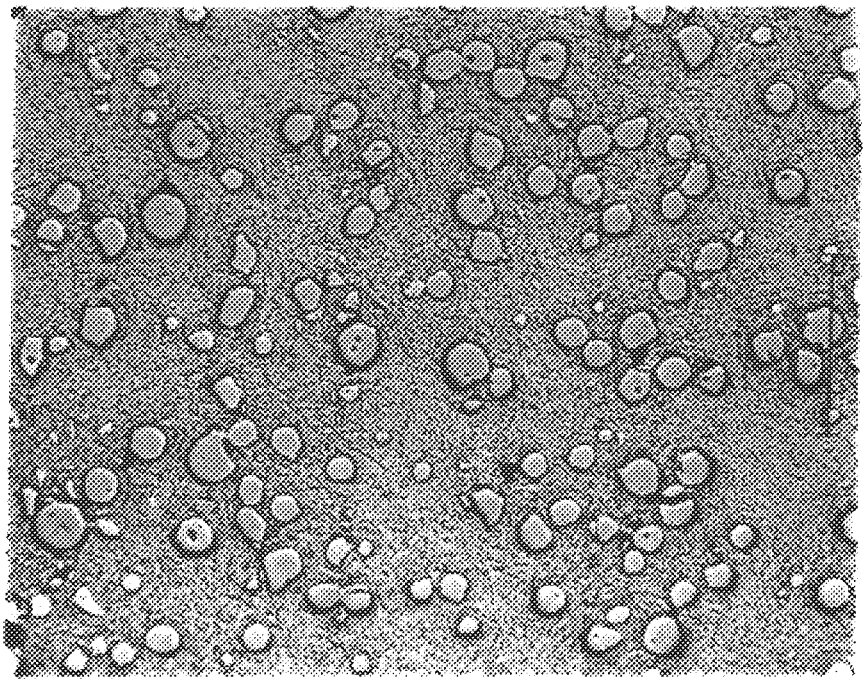
FIG. 2 is a microstructure of hot rolled composite material comprising an aluminum matrix and generally spherical, atomized quasicrystalline reinforcement powder particles dispersed in the matrix after hot rolling.

For purposes of illustration, referring to FIG. 2, a typical microstructure of a hot rolled composite sheet or plate of the invention after 65% reduction is shown wherein the matrix comprises pure aluminum and the quasicrystalline reinforcement powder comprises high pressure gas atomized, generally spherical powder particles comprising $Al_{65}Cu_{23}Fe_{12}$ and having a size range of 1 to 50 microns. Importantly, after hot rolling, the reinforcement powder particles have retained their general sphericalness and uniform distribution in the aluminum matrix without particle damage, such as particle cracking or a shape change where the particles are elongated by the rolling operation. A sound interfacial bond between the matrix and reinforcement particles is apparent. The hot rolling was conducted in multiple passes at a temperature of 450 degrees C (temperature of the composite body) using 5–10% thickness reduction per pass to reduce the original body thickness from 25.4 millimeters (mm) to a final hot rolled thickness of 8 mm; i.e. a total reduction in thickness of 68%.

Figure 3:
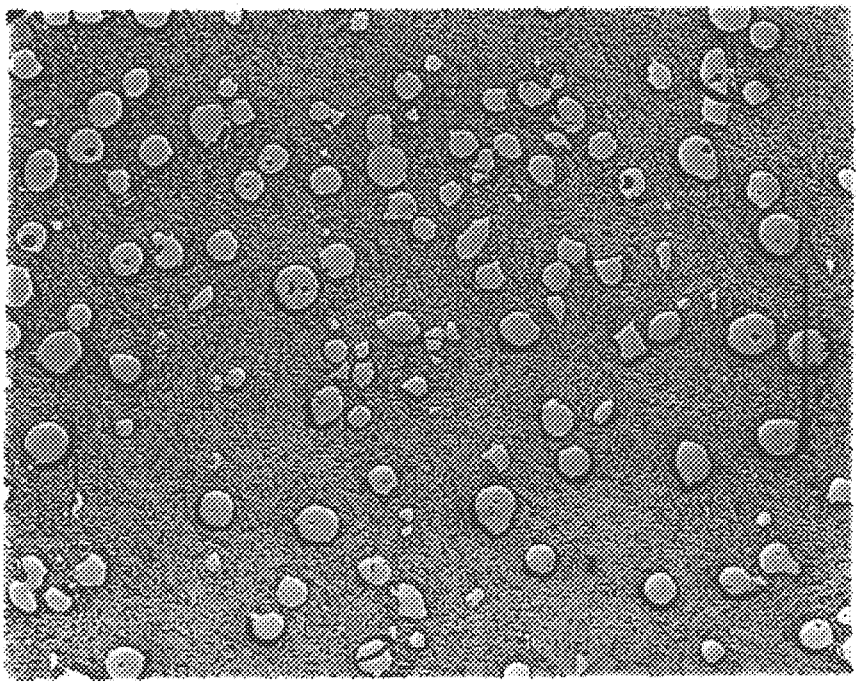
FIG. 3 is a microstructure of cold rolled composite material comprising an aluminum matrix and generally spherical, atomized quasicrystalline reinforcement powder particles dispersed in the matrix after cold rolling.

Referring to FIG. 3, a typical microstructure of a cold rolled composite sheet or plate of the invention after 65% reduction is shown wherein the matrix comprises pure aluminum and the quasicrystalline reinforcement powder comprises high pressure gas atomized, generally spherical powder particles comprising $Al_{65}Cu_{23}Fe_{12}$ and having a size range of 1 to 50 microns. Importantly, after cold rolling, the reinforcement powder particles have retained their general sphericalness and uniform distribution in the aluminum matrix without particle damage, such as particle cracking or a shape change where the particles are elongated by the rolling operation. A sound interfacial bond between the matrix and reinforcement particles is apparent, promoted by extensive deformation shearing of the relatively soft Al matrix around the relatively hard quasicrystalline particles. The cold rolling was conducted in multiple passes at room temperature using 5% thickness reduction per pass to reduce the original body thickness from 25.4 mm to a final cold rolled thickness of 8 mm; i.e. a total reduction in thickness of 68%.

Although hot rolling or cold rolling were used for purposes of illustration to reduce the thickness of the HIP'ed body, a combination of cold and hot rolling can be used to this same end to achieve a desired reduction in thickness to plate or sheet form where plate is typically considered to be in thickness range of 5 to 75 mm and sheet is typically considered to be in the thickness range of 1 to 5 mm.

The Table below sets forth the Young's modulus, yield strength, ultimate tensile strength, elongation, and density of the as-HIP'ed composite body, the hot rolled composite plate, and the cold rolled composite plate. For comparison purposes, like mechanical properties are set forth for wrought 1060 aluminum obtained from Metals Handbook, 8th Edition, Am. Soc. Metals 1961.

TABLE

| | Young's Modulus (MPa) | Yield Strength (MPa) | Tensile Strength (MPa) | Elongation % | Density g/cm$^3$ |
|---|---|---|---|---|---|
| 1060 Wrought Al | 68000 | 27.4 | 68.5 | 43 | 2.7 |
| 20% Quasicrystal Reinforced Pure Al composite(as Hipped) | 83400$^+$ | 79.4 | 103.6 | 8.5 | 2.98 |
| 20% Quasicrystal Reinforced Pure Al composite(as Hot Rolled) | 83400 | 127 | 143 | 4.7 | 2.98 |
| 20% Quasicrystal Reinforced Pure Al composite(as Cold Rolled) | 83400 | 207 | 216 | 2.1 | 2.98 |

*Data was taken from Metals Handbook 8th edition p.935–936 Am. Soc. Metals 1961
$^+$Determined by ultrasound technique.

It is apparent that substantial increases in both Young's modulus and strength values are achieved by the composite materials of the present invention. For example, the yield strength and ultimate tensile strength are increased by over 4 times and 2 times, respectively, in the hot rolled composite material of the invention. The yield strength and ultimate tensile strength are increased by over 6 times and 3 times, respectively, in the cold rolled composite material of the invention. The ductility of the composite materials of the invention is relatively good as compared to that (usually less than 1% elongation) of prior composite materials comprising 2024 aluminum matrix using 20 volume % angular SiC reinforcement particles in extruded, then rolled condition. Moreover, because of the enhanced ductility, the damage tolerance of the composite materials of the invention shown in FIGS. 2 and 3 will be improved due to the presence of generallly spherical reinforcement particles, rather than angular reinforcement particles, in the matrix. Thus, the present invention provides composite materials exhibiting substantially improved mechanical properties (e.g. high stiffness, strength, ductility, damage tolerance and low density).

The composite materials of the present invention will exhibit substantially improved high cycle fatigue resistance by virtue of the good interfacial bonding between the matrix and the quasicrystalline reinforcement particles as well as the non-faceted surfaces of the generally spherical, gas atomized quasicrystalline reinforcement particles. Such high cycle fatigue resistance makes the composite materials of the invention useful as electronic chip substrates.

Furthermore, the composite materials of the present invention described hereabove can be readily recycled when quantities are present as scrap from processing and machining the material into final component form as well as after the normal service life or usage of the component. In particular, the composite material of one embodiment of the invention are reinforced with quasicrystalline Al—Cu—Fe particles that have a relatively low initial melting temperature (solidus) of about 850 degrees C as compared to the high melting temperatures of the prior art reinforcement particles such as SiC, TiC, $B_4C$, $Al_2O_3$, etc.). The relatively low melting temperature of the reinforcements and the fact that Cu and Fe are typical alloy additions for many common Al alloys facilitates recycling by primary melting and refining.

Although the present invention is described in detail hereabove with respect to quasicrystalline Al—Cu—Fe alloys, such as the aforementioned $Al_{65}Cu_{23}Fe_{12}$ alloy, the invention is not so limited, and other quasicrystalline Al base and other alloys can be used in practicing the invention. Moreover, while the present invention has been described in terms of certain embodiments thereof for illustration purposes, it is not intended to be limited thereto but rather only to the extent set forth in the following claims.

We claim:

1. A composite material comprising a consolidated aluminum or aluminum alloy matrix, said material comprising preformed, substantially spherical, atomized quasicrystalline reinforcement particles having a size in the range of about 1 to about 100 microns diameter disposed in the matrix, said reinforcement particles being present in said matrix in an amount of about 5 to about 70 volume % thereby imparting improved mechanical properties and high ductility to said composite material.

2. The material of claim 1 wherein the reinforcement particles have been gas atomized.

3. The material of claim 1 wherein the reinforcement particles comprise Al alloy particles.

4. The material of claim 3 wherein the reinforcement particles comprise Al—Cu—Fe alloy particles.

5. A cold rolled composite material comprising an aluminum or aluminum alloy matrix which has been cold rolled, said matrix containing preformed, substantially spherical, atomized quasicrystalline reinforcement particles having a size in the range of about 1 to about 100 microns diameter, said reinforcement particles being present in said matrix in an amount effective to improve mechanical properties.

6. The material of claim 5 having a thickness of about 75 mm or less.

7. The material of claim 5 wherein the reinforcement particles comprise Al alloy particles.

8. The material of claim 7 wherein the reinforcement particles comprise Al—Cu—Fe alloy particles.

9. A hot rolled composite material comprising an aluminum or aluminum alloy matrix which has been hot rolled, said matrix containing preformed, substantially spherical, atomized quasicrystalline reinforcement particles having a size in the range of about 1 to about 100 microns diameter, said reinforcement particles being present in said matrix in an amount effective to improve mechanical properties.

10. The material of claim 9 having a thickness of about 75 mm or less.

11. The material of claim 9 wherein the reinforcement particles comprise Al alloy particles.

12. The material of claim 11 wherein the reinforcement particles comprise Al—Cu—Fe alloy particles.

* * * * *